US005964116A

United States Patent [19]

Bode et al.

[11] Patent Number: 5,964,116

[45] Date of Patent: Oct. 12, 1999

[54] ROLL STAND FOR ROLLING STRIP

[75] Inventors: Thorsten Bode, Erkrath; Hans-Peter Richter, Friedewald; Hans Georg Hartung, Pulheim, all of Germany

[73] Assignee: SMS Schloemann-Siemag Aktiengesellschaft, Düsseldorf, Germany

[21] Appl. No.: 09/132,708

[22] Filed: Aug. 12, 1998

[30] Foreign Application Priority Data

Aug. 23, 1997 [DE] Germany ..... 197 36 767

[51] Int. Cl.[6] ..... B21B 31/07; B21B 31/18

[52] U.S. Cl. ..... 72/247

[58] Field of Search ..... 72/245, 247, 241.2, 72/241.4, 241.6, 241.8, 242.2, 242.4, 243.2, 243.4, 243.6, 252.5

[56] References Cited

U.S. PATENT DOCUMENTS 4,683,744 8/1987 Ginzburg et al. ..... 72/247

FOREIGN PATENT DOCUMENTS

| | | | |
|---|---|---|---|
| 0049798 | 4/1984 | European Pat. Off. . | |
| 3637206 | 5/1987 | Germany . | |
| 196 26 565 A1 | 1/1998 | Germany . | |
| 61-126903-A | 6/1986 | Japan | 72/247 |
| 2-303602-A | 12/1990 | Japan | 72/241.4 |

*Primary Examiner*—Rodney Butler
*Attorney, Agent, or Firm*—Friedrich Kueffner

[57] ABSTRACT

A roll stand for rolling strip includes work rolls which rest against back-up rolls through intermediate rolls, wherein the work rolls and/or the back-up rolls and/or the intermediate rolls are arranged so as to be axially slidable relative to each other, and wherein at least the work rolls and/or the intermediate rolls have a curved or cylindrical contour extending over the entire roll length. The work rolls and the intermediate rolls have at one of their end faces an annular recess extending around the roll neck, wherein the annular recess is located between the roll neck and the outer surface of the roll.

2 Claims, 3 Drawing Sheets

FIG. 2
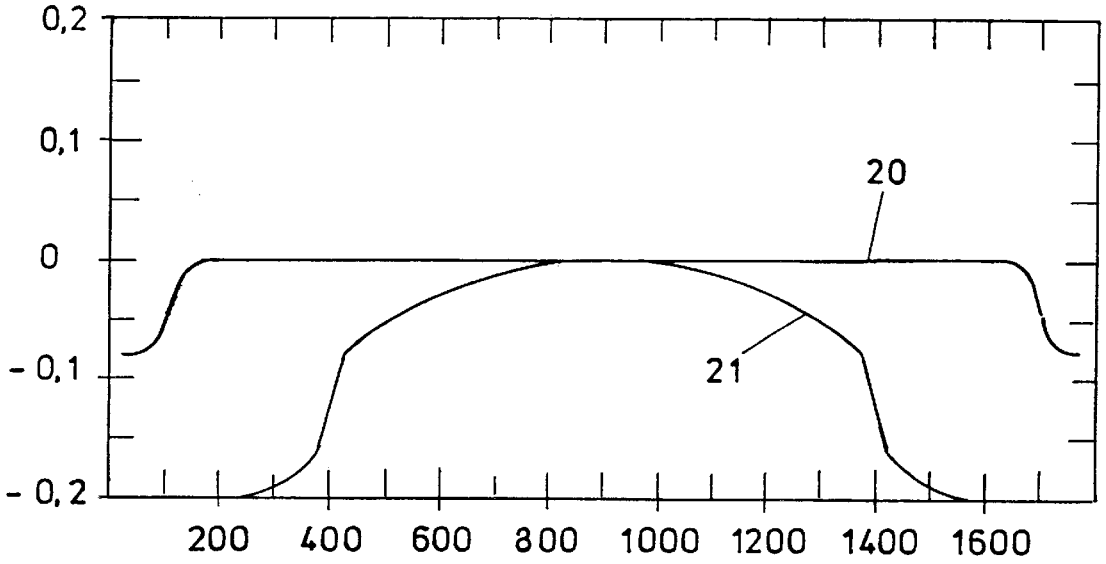
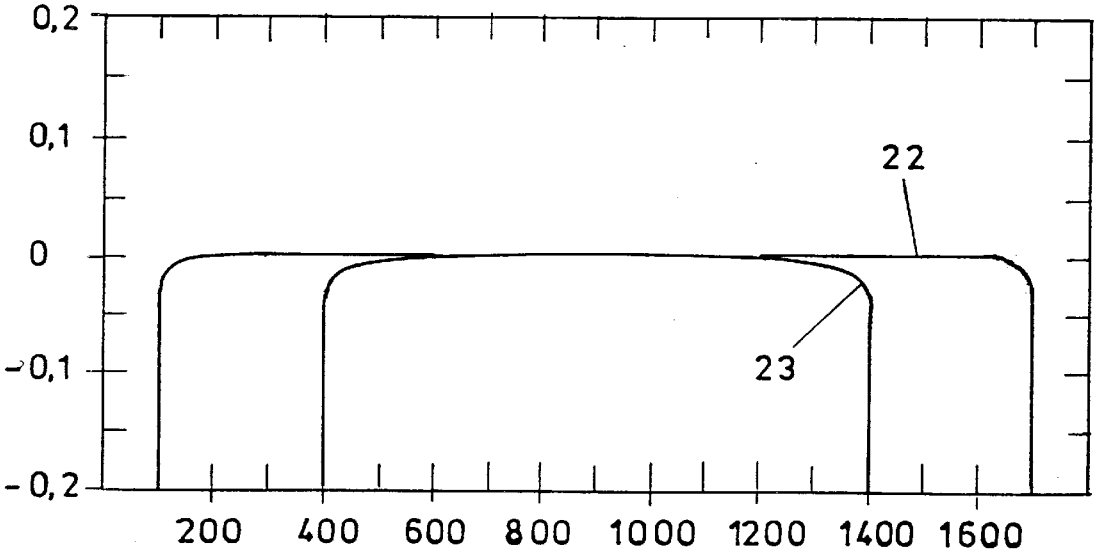
FIG. 3

0,2
0,1
0
- 0,1
- 0,2
24
25
200
400
600
800
1000
1200
1400
1600

20
10
0
26
200
400
600
800
1000
1200
1400
1600

20
10
0
27
200
400
600
800
1000
1200
1400
1600

ROLL STAND FOR ROLLING STRIP

BACKGROUND OF THE INVENTION

1. Field of the Invention

The present invention relates to a roll stand for rolling strip. The roll stand includes work rolls which rest against back-up rolls through intermediate rolls, wherein the work rolls and/or the back-up rolls and/or the intermediate rolls are arranged so as to be axially slidable relative to each other, and wherein at least the work rolls and/or the intermediate rolls have a curved or cylindrical contour extending over the entire roll length.

2. Description of the Related Art

When rolling strip of different widths, it is usually necessary for achieving the desired planarity to adjust the crown of the work rolls which is responsible for the planarity. The change of the crown is effected in such a way that the crown of the work roll must be increased with decreasing strip width. This is a result of the increasing supporting effect of the intermediate rolls and the back-up rolls next to the strip edges of the rolling stock which cause the work rolls to be bent adjacent the strip edges; this can only be compensated by a corresponding increase of the crown of the work rolls when the strip width decreases.

Bending of the work rolls causes a thickness reduction of the rolling stock in the areas of the strip edges and an attendant edge sharpening of the rolled strip. In addition to bending of the work rolls, also responsible for this effect is the decrease of the elastic deformations of the work rolls in the unloaded areas next to the rolling stock caused by the rolling load. The better the friction is between the rolls and the rolling stock and the thinner the work rolls are, the more sudden this thickness change of the strip takes place. The drop in thickness of the strip edges increases with increasing strength of the rolling stock and increasing diameter of the work rolls.

In accordance with the prior art, axially displaceable rolls are used for meeting the various requirements with respect to the crown of the rolls for the planarity of the strips and for avoiding the sharpening of the strip edges, so that the entire crown range is covered by only one roll or a pair of rolls.

For example, EP 0 049 798 B1 proposes to provide the work rolls with a curved contour which extends over the entire length of the bodies of both rolls and has a shape in which the two body contours complement each other exclusively in one relative axial position of these rolls. This makes it possible to influence the shape of the roll gap, and, thus, the cross-sectional shape of the rolled strip just by slight displacement distances of the rolls having the curved contours and to also influence the edge pressure and to reduce the edge pressure for preventing the sharpening of the edges.

However, a treatment of the entire strip takes place simultaneously with this influence on the strip edges. For rendering the load distribution uniform, EP 00 91 540 B1 proposes to provide the work rolls as well as the back-up rolls and possibly the intermediate rolls over the entire body length thereof with a bottle-shaped, S-shaped contour which is composed of a convex portion and a concave portion and has a shape where the body contours of rolls which rest against each other or interact complement each other exclusively in one specific relative axial position of these rolls (CVC technology). All rolls are arranged so as to be axially displaceable. Consequently, by a relative axial displacement of the rolls of any of the roll pairs, the contour of the roll gap can be sensitively influenced. However, this known roll stand also still has the disadvantage that the planarity of the strip and the edge pressure are influenced simultaneously.

DE 36 37 206 C2 describes another solution for compensating the disadvantageous effect of roll bending in connection with a four-high rolling mill. The proposed solution is to construct a back-up roll in such a way that the undesired deflections produced by the rolling load are automatically compensated by providing the back-up roll with a solid axial internal portion in the form of a core shaft and an outer circumferential portion in the form of a sleeve, wherein generally cylindrical, outwardly open hollow spaces are arranged between the internal portion and the outer circumferential portion. As a result of this measure, the free ends of the sleeve are bent under the rolling load in a direction opposite to the direction in which they would normally bend if no hollow spaces were provided, wherein bending takes place by a distance which is essentially equal to bending of the core shaft, so that the contact surface between the work roll and the strip material remains essentially flat.

A measure which acts even more directly is described in a not prepublished patent application (Application No. 19626565.7). In order to achieve a uniformity of the strip thickness in the edge areas, the work rolls are provided with notches which extend concentrically about the axes of the work rolls, which results in a different flattening behavior of the roll body provided with the notches as compared to the adjacent solid roll body. A greater flattening takes place at the strip edges as a result of the lacking inner support due to the notches or hollow spaces which cause the strip thickness to be rendered uniform in the width direction of the strip.

SUMMARY OF THE INVENTION

Therefore, it is the primary object of the present invention, starting from the prior art discussed above, to provide a roll stand in which it is possible to influence in a simple manner simultaneously and independently of each other the profile and planarity of strip edge and strip center even in strips having different widths, and in which the strip edge pressure and edge sharpening can be reduced.

In accordance with the present invention, the work rolls and the intermediate rolls have at one of their end faces an annular recess extending around the roll neck, wherein the annular recess is located between the roll neck and the outer surface of the roll.

Since, in accordance with the present invention, on the level of the work rolls as well as on the level of the intermediate rolls, the rolls are on one side provided with an annular recess, wherein the recesses are arranged on opposite sides in the work roll and the intermediate roll, an optimum weakening of the supporting effect of the back-up rolls can be achieved adjacent the strip edges. This is because above and below the rolling stock is always one roll body end in the area of the strip edges which because of an annular recess makes it possible to achieve a weaker supporting effect. As a result of these measures, the work rolls are not bent as strongly around the strip and the crown area for the desired planarity of narrow and wide strip is significantly limited.

In this connection, to achieve this effect, it is not necessary that the recess continuously overlaps the strip. Consequently, it is sufficient to provide the work roll with a basic crown in order to achieve the desired planarity for the strip middle with the axial displacement of the work rolls and with a control element for work roll and intermediate roll bending. In accordance with the present invention, the basic crown is not interrupted by the area of the recesses, but extends over these areas.

By operating the work rolls and/or the intermediate rolls in a manner which takes into consideration the strip edges, it is additionally possible to favorably influence the profile and planarity of the strip edge to the desired extent.

The shape and size of the annular recesses according to the present invention can be freely selected and, thus, adapted in an optimum manner to the strip to be rolled. In accordance with an advantageous further development of the invention, it is entirely possible to select annular recesses for the intermediate rolls which deviate with respect to shape and size from the recesses of the work rolls.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 2 is a diagram of the roll gap profile of a six-high roll stand according to the prior art;

FIG. 3 is a diagram of the roll gap profile of a six-high roll stand according to the invention;

DESCRIPTION OF THE PREFERRED EMBODIMENTS

Figure 1:
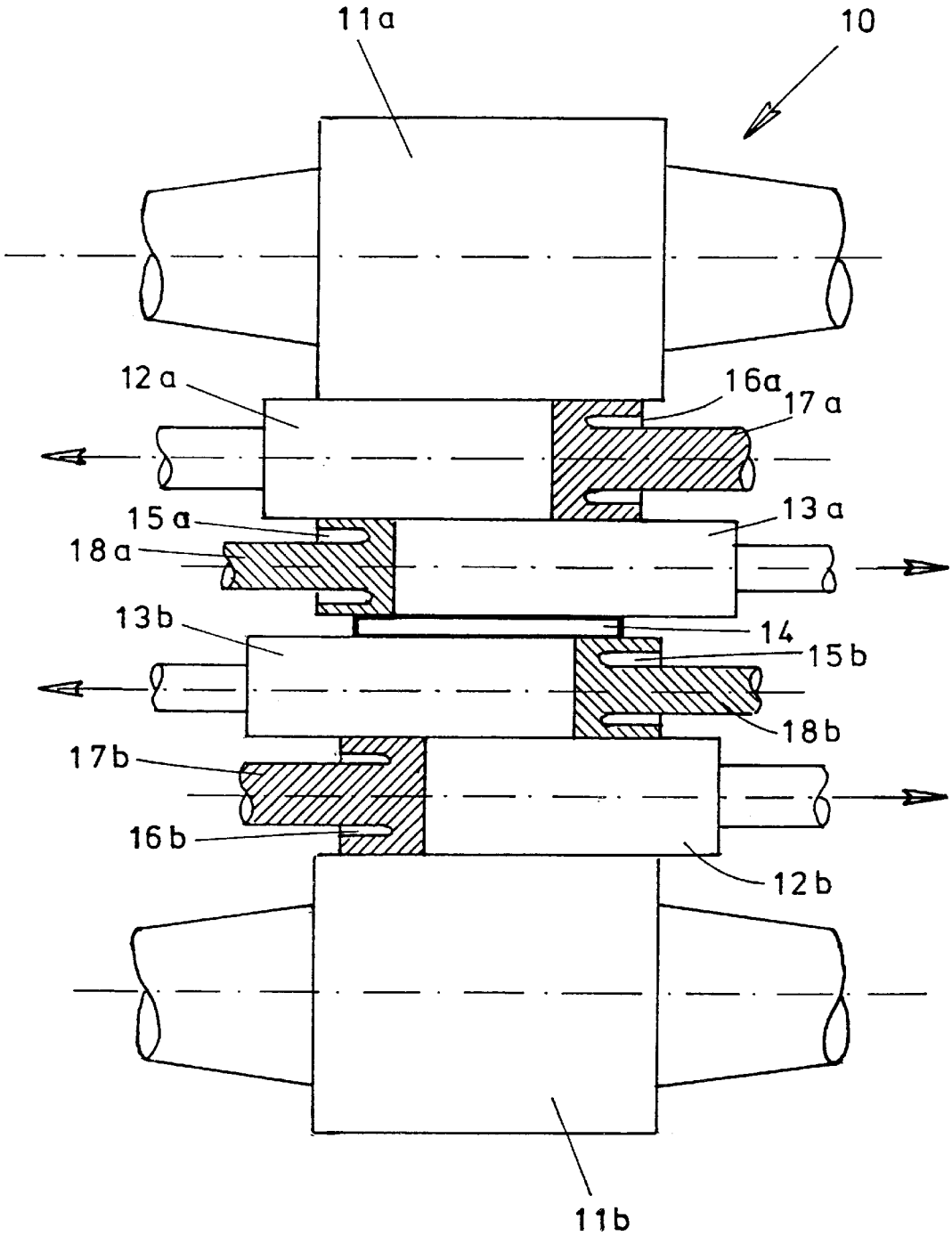
FIG. 1 is a six-high roll stand according to the present invention.

FIG. 1 of the drawing schematically shows the roll arrangement of a six-high roll stand 10 with two work rolls 13*a*, 13*b*, two intermediate rolls 12*a*, 12*b* and two back-up rolls 11*a*, 11*b*.

The work rolls 13*a*, 13*b* and the intermediate rolls 12*a*, 12*b* are each provided at one roll end with an annular recess 15*a*, 15*b*, 16*a*, 16*b* and are arranged in such a way that the recesses 15*a*, 15*b*, 16*a*, 16*b* extending annularly around roll necks 17*a*, 17*b*, 18*a*, 18*b* are located above and below the rolling stock 14 on opposite sides of the work rolls 13*a*, 13*b* and the intermediate rolls 12*a*, 12*b* in the areas of the strip edges.

Consequently, in the illustrated embodiment, the back-up effect in the area to the left of the strip edge is reduced by the annular recess 15*a* of the work roll 13*a* and in the area to the right of the strip edge by the annular recess 16*a* of the intermediate roll 12*a* and, as a result, the work roll 13*a* is bent to a lesser extent around the strip 14. The same is true for the lower set of rolls in which the rolls are arranged turned by 180° each relative to the rolls of the upper roll set.

Figure 4:
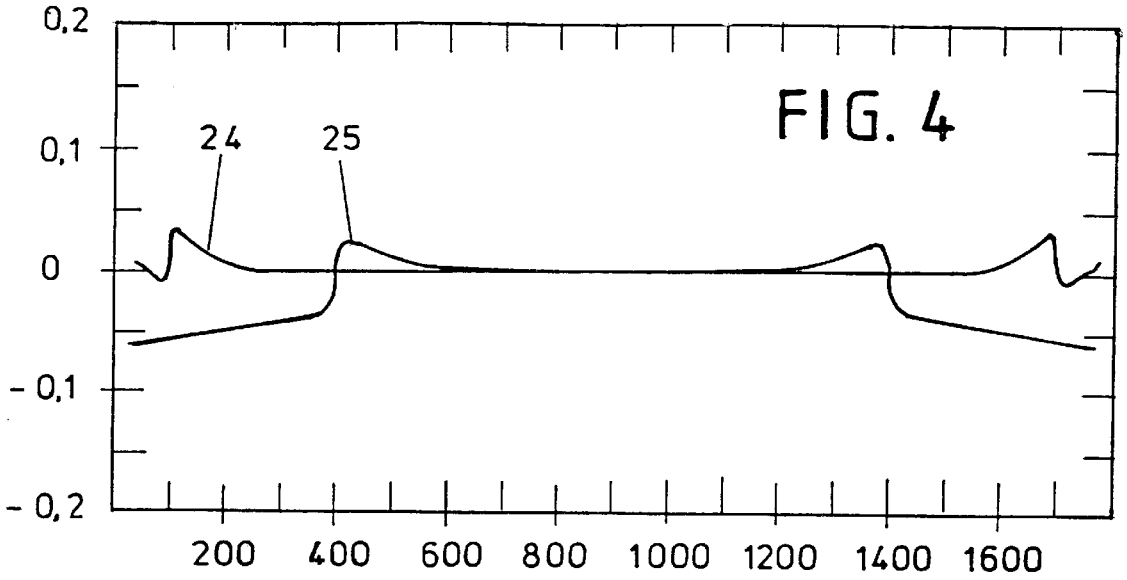
FIG. 4 is a diagram of the roll gap profile of a six-high roll stand according to the invention.
Figure 5:
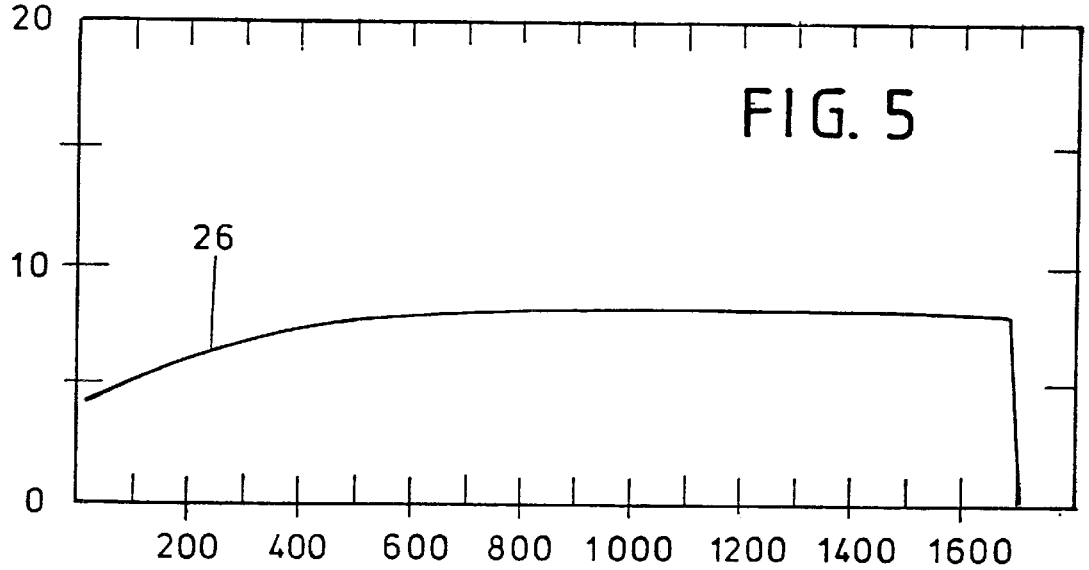
FIG. 5 is a diagram of the load distribution of work roll/intermediate roll for a six-high roll stand according to the prior art.
Figure 6:
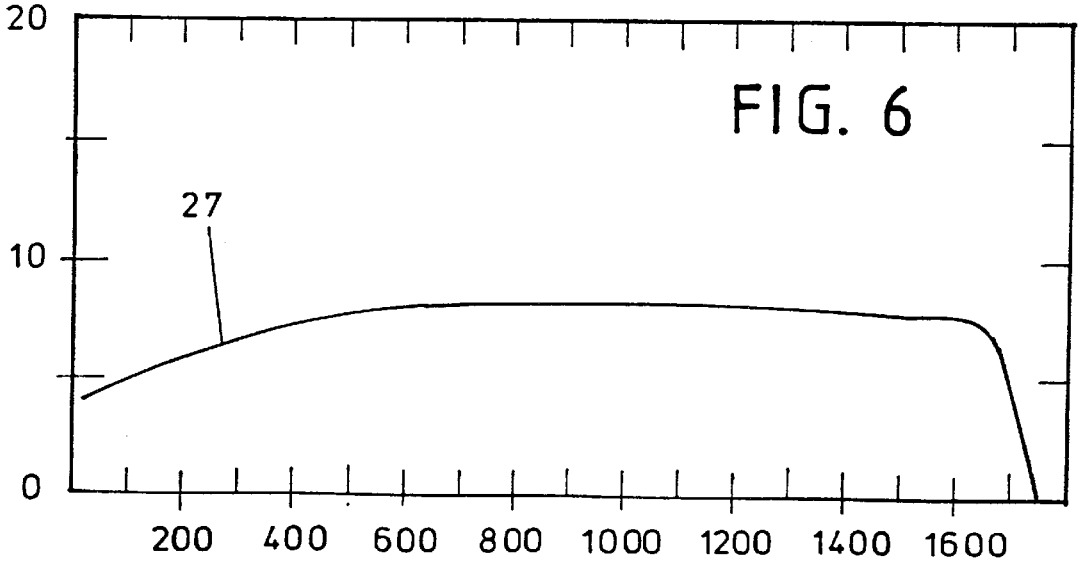
FIG. 6 is a diagram of the load distribution of work roll/intermediate roll for a six-high roll stand according to the invention.

The diagrams of FIGS. 2 to 6 demonstrate the results that can be achieved with the rolls according to the present invention, wherein the width is plotted in mm on the abscissas; in FIGS. 2 to 4, the ordinates indicate the crown in mm, and in FIGS. 5 and 6 the ordinates indicate the rolling force in kN/mm.

FIG. 2 shows the roll gap profile (illustrated symmetrically) for a six-high roll stand with continuous solid rolls according to the prior art in connection with two strips having different widths. The crown of the work roll was selected with 1.1418 mm in such a way that a rectangular roll gap profile 20 is formed for the wide strip having a width of 1600 mm. On the other hand, with the same crown of the work rolls, in the case of a narrower strip having a width of 1000 mm, an unsatisfactory roll gap profile 21 is formed with a parabolic planarity error of 162 $\mu$m, which would have to be compensated by an increased crown of the work rolls of 0.493 mm.

FIG. 3 shows the symmetrical roll gap profiles which result in the case of the same strip widths and the same rolling load when using a roll arrangement according to the present invention shown in FIG. 1. In the areas of the recesses, both rolls have a wall thickness of 65 mm and the rolls are displaced relative to each other in this example in such a way that the recess bottom coincides with the strip edges in the case of both strip widths. In this example, the work roll crown was selected with 0.0418 mm in such a way that a rectangular roll gap profile 22 is once again formed for the wide strip having a width of 1600 mm. However, a rectangular cross-section 23 is now also almost achieved for the roll gap profile for the narrower strip having a width of 1000 mm with an undesired parabolic error of only 15.4 $\mu$m, i.e., less than a tenth of the parabolic error of the solid rolls. This small error can be eliminated just by using, for example, bending of the work rolls; further grinding with a greater crown of the work rolls is not necessary.

FIG. 4 shows the roll gap profiles for the wide strip 24 and the narrower strip 25 in another example. With all other adjustments being the same as in the example of FIG. 3, the work rolls are displaced for both strip widths in such a way that the recess bottom overlaps over the strip over a length of 15 mm. The position of the intermediate rolls remained unchanged. FIG. 4 shows how the strip edge is additionally influenced with respect to the edge drop with a suitable displacement of the work roll. For achieving an advantageous effect on the planar position, a positioning of the work roll recesses which is precise within millimeters is not required, especially since the positioning of the intermediate roll recesses provides another adjustment possibility.

Consequently, the positioning freedom limited to the strip edge area permits an individual influence on the strip edge with respect to planarity and profile or edge drop. Thus, the roll arrangement according to the present invention makes it possible to adjust profile and planarity of strip edge and strip middle independently of each other by appropriate displacements of the work rolls or the intermediate rolls.

The two additional diagrams of FIGS. 5 and 6 once again emphasize the advantage of the invention as compared to the prior art using roll stands with solid rolls. Since the roll body edge of the intermediate roll in the form of a solid roll is displaced within the body of the intermediate roll, a sudden drop of the load in the area of this displacement edge occurs which leads to undesirable markings on the rolls. FIG. 5 shows the load distribution between the work roll and the intermediate roll of such a roll stand plotted over the roll width, showing the significant sharp drop at the end of the curve 26 on the right hand side.

When using rolls with the annular recesses according to the present invention, a flatter load drop occurs in the area of the displacement edge because the "softer" roll portion with its recess is effective at this edge; this is illustrated in the diagram of FIG. 6 showing the curve 27 which drops less sharply toward the right. This flat load drop causes the rolls to be treated more gently and does not result in the undesired markings.

While specific embodiments of the invention have been shown and described in detail to illustrate the inventive principles, it will be understood that the invention may be embodied otherwise without departing from such principles.

We claim:

1. A roll stand for rolling strip, the roll stand comprising upper and lower work rolls, upper and lower intermediate rolls resting against the work rolls, and upper and lower back-up rolls resting against the intermediate rolls, wherein at least one of the work rolls and the back-up rolls and the intermediate rolls are mounted so as to be axially displaceable relative to one another, and wherein at least one of the work rolls and the intermediate rolls have a curved or cylindrical contour extending over an entire length of the rolls, the work rolls and the intermediate rolls having end faces, roll necks and an outer surface, wherein the work rolls and the intermediate rolls each have at one of the end faces a recess extending annularly around the roll necks and extending between the roll necks and the outer surface of the roll, wherein each roll having a recess has a middle roll portion with solid cross-section, and wherein a contour of the outer roll surface in the area of the annular recess is a continuation of the contour of the outer surface of the roll portion having the solid cross-section, and wherein the work rolls and the intermediate rolls are arranged axially displaced and offset relative to each other by 180° in a plane of the strip in such a way that each edge of the strip is located in areas of the annular recesses of the work rolls and of the intermediate rolls, wherein the area of the annular recess of the upper work roll is located opposite the area of the annular recess of the lower intermediate roll and the area of the annular recess of the lower work roll is located opposite the area of the annular recess of the upper intermediate roll, and wherein the upper work roll and the upper intermediate roll are offset relative to the lower work roll and the lower intermediate roll by 180° in the plane of the strip.

2. The roll stand according to claim 1, wherein each annular recess has a shape and a size, wherein the shape and the size of the annular recesses of the work rolls differs from the shape and the size of the annular recesses of the intermediate rolls.

* * * * *